US006312108B1

(12) United States Patent
Kato

(10) Patent No.: US 6,312,108 B1
(45) Date of Patent: Nov. 6, 2001

(54) INK-JET HEAD

(75) Inventor: Seiichi Kato, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/369,631

(22) Filed: Aug. 6, 1999

(30) Foreign Application Priority Data

Aug. 7, 1998 (JP) ..... 10-224120

(51) Int. Cl.[7] ..... B41J 2/04
(52) U.S. Cl. ..... 347/54
(58) Field of Search ..... 347/59, 9, 12, 347/54, 13

(56) References Cited

U.S. PATENT DOCUMENTS 5,055,859 * 10/1991 Wakabayashi et al. ..... 347/59
5,075,250 * 12/1991 Hawkins et al. ..... 438/21
5,157,419 * 10/1992 Matsumoto et al. ..... 346/140 R
5,216,447 * 6/1993 Fujita et al. ..... 346/140 R
5,666,142 * 9/1997 Fujita et al. ..... 347/59
5,734,395 * 3/1998 Kamisuki et al. ..... 347/59
5,850,242 * 12/1998 Asaba ..... 347/59
6,076,914 * 6/2000 Imai ..... 347/59

FOREIGN PATENT DOCUMENTS 3-224741 * 10/1991 (JP) ..... 347/59
3-227639 * 10/1991 (JP) ..... 347/59
6-55732 3/1994 (JP) ..... B41J/2/45

* cited by examiner

*Primary Examiner*—John Barlow
*Assistant Examiner*—Robert D Loper, Jr.
(74) *Attorney, Agent, or Firm*—Greenberg Traurig LLP

(57) ABSTRACT

An ink-jet head includes a diaphgram and an electrode for emitting ink therefrom during a printing process. An electrostatic force is produced between the diaphragm and the electrode to thereby deform the diaphragm and pressurize liquid contained therein such that the liquid is fired by a restoration force of the diaphragm. The electrode includes a diffused layer in a Si substrate and an active device which acts as a driving circuit is provided in the Si substrate.

23 Claims, 6 Drawing Sheets

INK-JET HEAD

BACKGROUND OF THE INVENTION

1. Field of the Invention

The present invention relates to an ink-jet head, and, more specifically, to a structure of an ink-jet head in an ink-jet recording apparatus and a method of making such an ink-jet head.

2. Description of the Related Art

On-demand-type ink-jet heads are widely known. As a result of the demand for performing printing in color, and, for high-quality printing and high-speed printing, there has been a requirement that the number of nozzles and the nozzle density of ink-jet heads be increased.

One conventional ink-jet head has a structure and operation which are simple and which achieves high ink-jet-head density. This ink-jet head has a system in which an electrostatic force is produced between a diaphragm and an electrode, the diaphragm is deformed, and a liquid is pressurized due to the restoration force of the diaphragm so that the liquid is fired. A diffused layer in a Si substrate is used as the electrode.

Japanese Laid-Open Patent Application No. 6-55732 discloses an ink-jet head in which a metal layer is formed so that the resistance of a diaphragm is reduced without reducing the resistance of a Si substrate in order to provide a driving device in the Si substrate which is integral with the diaphragm.

In such an electrostatic-type ink-jet head, ink is fired using the restoration force produced due to elasticity of the diaphragm. In this ink-jet head, the short-side-direction width of the diaphragm must be narrowed due to the increase in the nozzle density. The displacement of the diaphragm is proportional to the fourth power of the short-side length thereof. Therefore, the driving voltage must be very high in order to obtain sufficient displacement of the diaphragm. For example, in a case where the short-side length is 55 $\mu$m, the driving voltage reaches a voltage of about 150 V. When the nozzle density increases, the total number of nozzles increases. Therefore, when the cost of the driving circuit for each nozzle increases due to the increase in the driving voltage, the total cost increases greatly.

SUMMARY OF THE INVENTION

To overcome the problems described above, preferred embodiments of the present invention provide an ink-jet head which includes a high-voltage-driving active device such as a MOS transistor disposed in a substrate such that little change is required to the manufacturing process of the ink-jet head, it is possible to use an inexpensive, low-voltage driving circuit, and there is no increase in the total cost of the ink-jet head.

In a structure of an ink-jet head according to preferred embodiments of the present invention, a driving circuit is not provided in a Si substrate on the side of a diaphragm, but, instead, an active driving device is manufactured so as to be integral with an electrode substrate via a semiconductor-device manufacturing technique. Accordingly, it is possible to easily manufacture the ink-jet head, and to prevent increase in the cost of the ink-jet head.

In an ink-jet head, according to prefererred embodiments of the present invention, an electrostatic force is produced between a diaphragm and an electrode, the diaphragm is thus deformed, and liquid is pressurized and fired by restoration force of the diaphragm, wherein a diffused layer on a Si substrate is used as the electrode, and an active device which acts as a driving circuit is formed in the Si substrate.

Thus, as a result of providing the active device in the electrode substrate for each nozzle, it is possible to prevent any increase in the driving voltage, which increase results from reduction in the short-side length of each diaphragm in order to achieve a high nozzle density. That is, it is possible to control the driving device, such as a MOS transistor, so as to control the diaphragm by inputting a signal to the gate using an inexpensive, low-voltage driving circuit.

In an ink-jet head, according to another preferred embodiment of the present invention, the ink-jet head is constructed such that an electrostatic force is produced between a diaphragm and an electrode, the diaphragm is thus deformed, and liquid is pressurized and fired by restoration force of the diaphragm, wherein a diffused layer in a Si substrate is used as the electrode, and the diffused layer is a part of a MOS transistor.

Thus, as a result of providing the MOS transistor for each nozzle, it is possible to prevent any increase in the driving voltage, which results from reduction in the short-side length of each diaphragm, in order to achieve a high nozzle density. That is, it is possible to control the MOS transistor so as to control the diaphragm by inputting a signal to the gate using an inexpensive, low-voltage driving circuit.

The MOS transistor for controlling a voltage applied to the electrode for driving the diaphragm and a MOS transistor for causing an electric charge to escape from the electrode may be provided for each nozzle.

As a result of providing the MOS transistor for discharging electric charge for each nozzle, it is possible to prevent reduction in the driving frequency of diaphragm.

Other elements, features, and advantages of the present invention will become more apparent from the following detailed description of preferred embodiments of the present invention when read in conjunction with the accompanying drawings.

DETAILED DESCRIPTION OF PREFERRED EMBODIMENTS

Figure 1A:
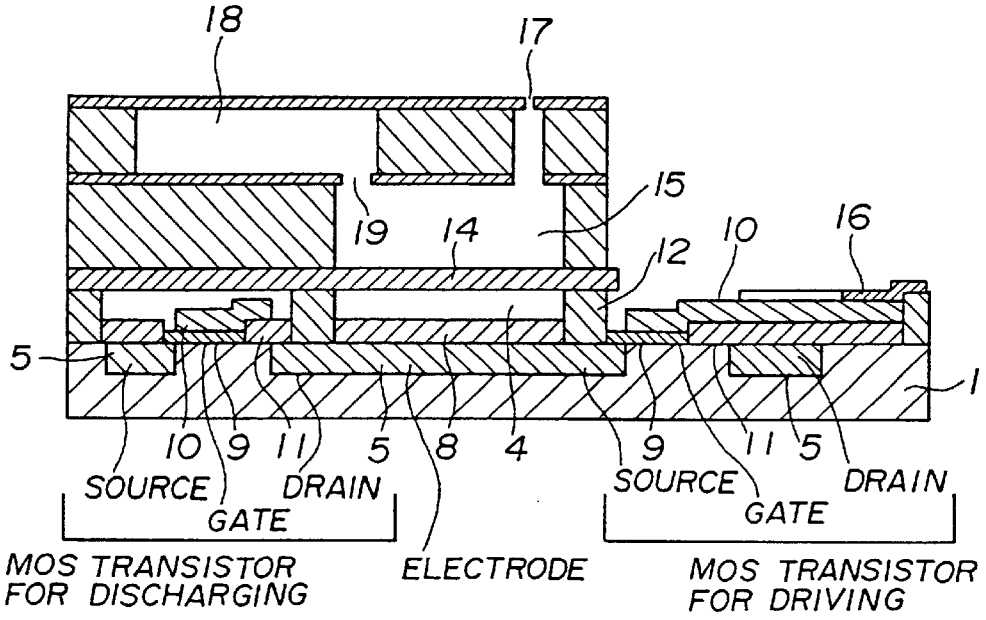
FIG. 1A is a sectional view of one example of an ink-jet head according to a preferred embodiment of the present invention.
Figure 1B:
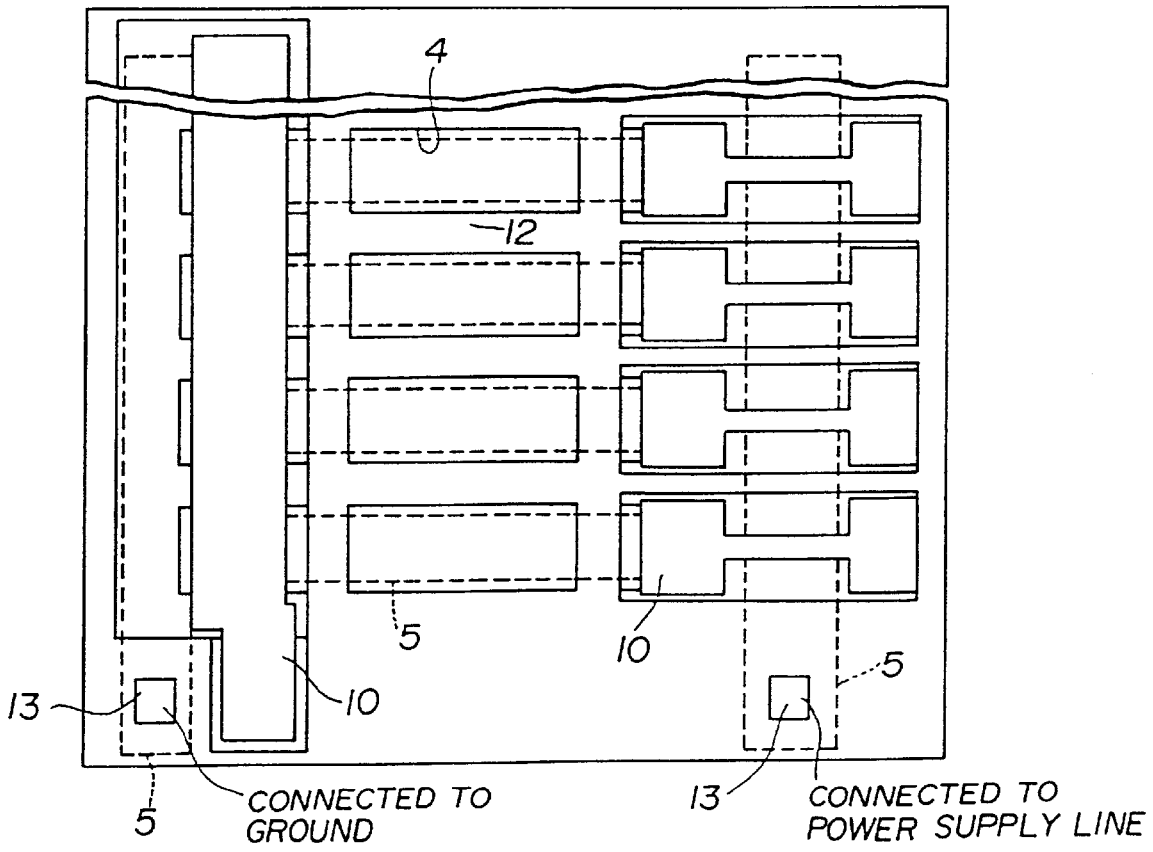
FIG. 1B is a plan view showing one example of an ink-jet head according to a preferred embodiment of the present invention.

FIGS. 1A and 1B illustrate a structure of an ink-jet head according to a preferred embodiment of the present invention. The ink-jet head preferably includes a Si substrate 1, a gap 4, n-type diffused layers 5 defining sources and drains as explained later, a passivation oxide film 8, gate oxide films 9, polysilicon gates 10, thick gate oxide films 11, barrier plates 12, contact holes 13, a single-crystal Si diaphragm 14, a pressurizing liquid chamber 15, an Al—Si pad 16, a nozzle 17, a common liquid chamber 18 and a liquid-course resistance 19.

As shown in FIG. 1A, a first MOS transistor for driving the diaphragm preferably includes a drain (5), source (5) and a gate (9). The drain (5) of this first transistor is connected to a power supply line. A second MOS transistor for discharging electric charge from the electrode includes a drain (5), a source (5) and a gate (9). The source (5) of the second MOS transistor is connected to ground.

When the first MOS transistor for driving the diaphragm is turned on, electric charge is supplied to the source (5) from the drain (5) through the first MOS transistor. An electric charge is stored in the electrode (5). As a result, electrostatic force is produced between the diaphragm (14) and the electrode (5). Consequently, the diaphragm 14 is attracted and is moved downward due to the electrostatic force. As a result, the volume of the pressurizing liquid chamber (15) is enlarged.

Then, the second MOS transistor for discharging electric charge is turned on. The electric charge stored in the electrode (5) is discharged to the ground through the second MOS transistor via the source electrode (5). As a result, the electrostatic force produced between the diaphragm (14) and the electrode (5) is eliminated, and, thereby, the diaphragm (14) returns to the original position through elastic restoration force of the diaphragm (14). As a result, the volume of the pressurizing liquid chamber (15) is reduced. Thereby, ink contained in the pressurizing liquid chamber (15) is pressurized, and is fired through the nozzle 17. The first MOS transistor for driving the diaphragm and the second MOS transistor for discharging electric charge are controlled as a result of appropriate signals being input to the gates of the respective first and second MOS transistors.

With reference to FIGS. 2A through 2I, an example of a manufacturing process for producing a high-density ink-jet head having a nozzle density of about 300 dpi according to a preferred embodiment of the present invention will now be described. Although description will be made of an example using p-channel MOS devices, it is also possible to manufacture a similar ink-jet head using n-channel MOS devices. A substrate-manufacturing process for the ink-jet head according to an example of this preferred embodiment of the present invention using a common MOS-device manufacturing process will now be described.

Figure 2A:
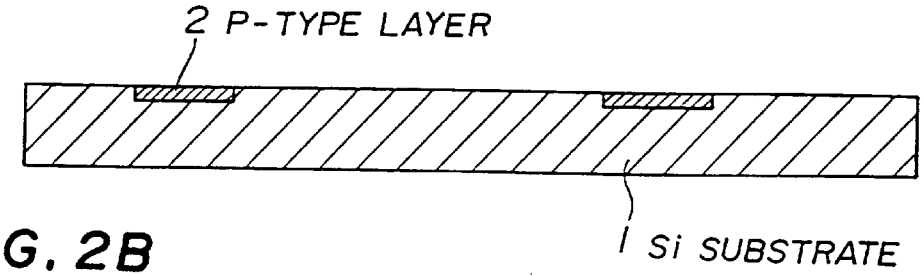
FIGS. 2A, 2B, 2C, 2D, 2E, 2F, 2G, 2H and 2I show steps in a manufacturing process of the ink-jet head according to a preferred embodiment of the present invention.

(A) A (100) single-crystal p-type Si substrate 1 having a sheet resistance of about 100 Ωcm is prefereably used. Patterning of a resist is performed by photolithography, and ion implantation of B (boron) to a dose of about $1\times10^{12}/cm^2$ is performed at an energy of about 30 keV. As a result, a p-type impurity layer 2 is formed. This impurity layer 2 is called a channel stopper wherein an acceptor impurity is previously provided so as to prevent the n-type inversion layer from spreading to the side surface of the gate and to prevent occurrence of a current leakage (FIG. 2A).

Figure 2B:
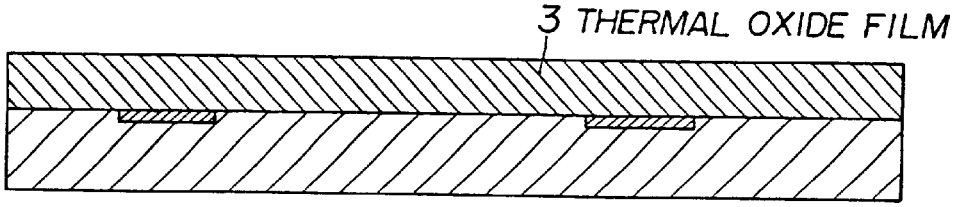

(B) A thermal oxide film 3 having a thickness of about 500 nm is formed through thermal oxidation at about 1000° C. (FIG. 2B).

Figure 2C:
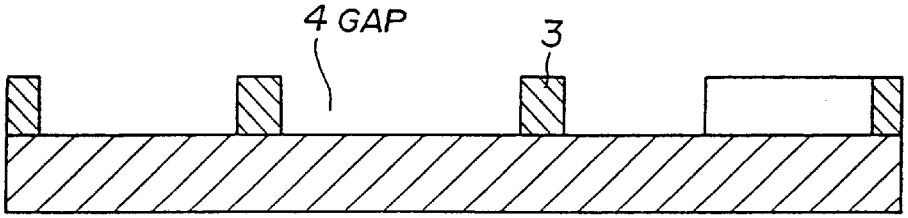

(C) A pattern for the gap 4 between the diaphragm and the electrode is formed using photoresist via photolithography. Dry etching (RIE: Reactive Ion Etching) is performed on the oxide film using $CHF_3$ gas, and, thus, the Si surface is exposed (FIG. 2C).

Figure 2D:
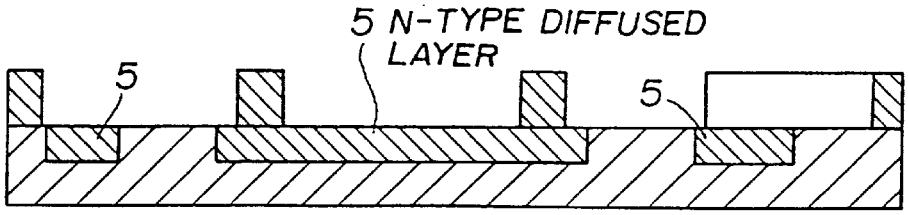

(D) A resist pattern is formed via photolithography, ion implantation of P to a dose of about $3\times10^{15}/cm^2$ is performed at an energy of about 50 keV, heat treatment is performed for about 40 minutes in an atmosphere of nitrogen at about 1150° C., and, thus, the $n^+$ diffused layers 5 are formed (FIG. 2D).

Figure 2E:
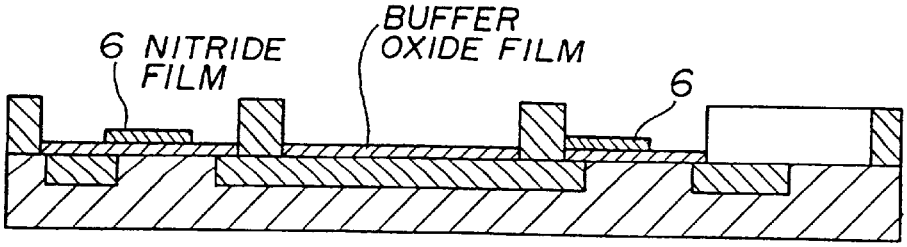

(E) In order to perform selective oxidation in the LOCOS method, buffer oxide films having a thickness of about 20 nm are formed, and a silicon nitride film 6 is formed by LPCVD. Then, a resist pattern is formed by photolithography, and openings are formed in the nitride film through dry etching (FIG. 2E).

Figure 2F:
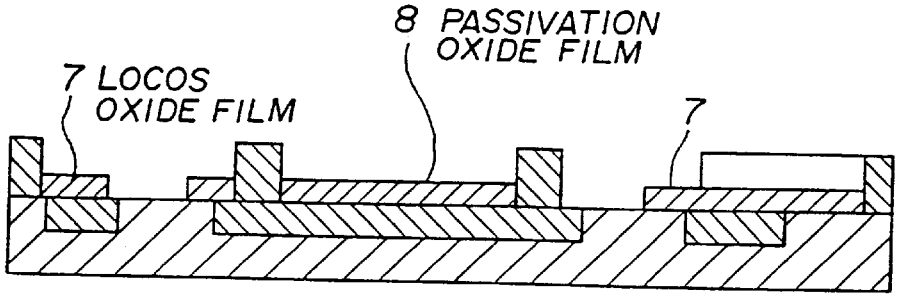

(F) Thermal oxidation of about 210 nm is performed, and, thus, LOCOS oxide films 7 and the passivation oxide film 8 on the diffused electrode are formed. Then, etching of a thickness of about 10 nm is performed on the oxide films using an aqueous solution of HF, and etching is performed on the nitride films through all the surfaces thereof using thermal phosphoric acid (FIG. 2F).

Figure 2G:
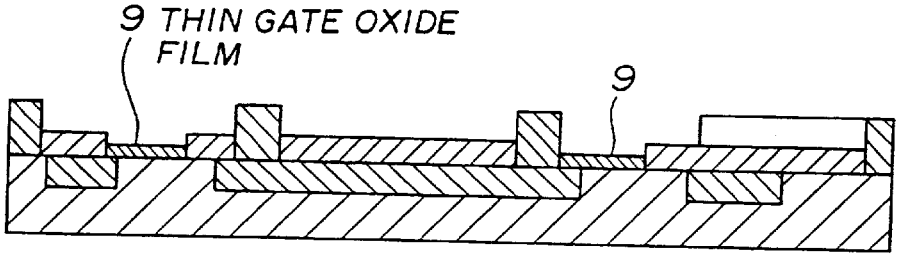

(G) Dry oxidation is performed, and, thus, a gate oxide film 9 having a thickness of about 50 nm is formed (FIG. 2G).

(H) Polysilicon of about 400 nm is formed in the LPCVD method using $SiH_4$ with the substrate having the temperature of about 540° C. In an atmosphere of $PH_3$ at about 850° C., heat treatment is performed for approximately 30 minutes.

Figure 2H:
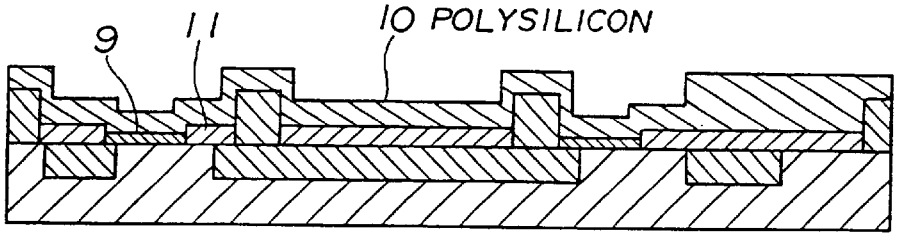

Thus, P is diffused in the polysilicon. The useless oxide films on the surface are removed using hydrofluoric acid. Thus, the polysilicon 10 is formed. The thickness of the polysilicon 10 is preferably about 350 nm. The polysilicon lies on the gate oxide film 9 (thin oxide film) which is thin and preferably has a thickness of about 50 nm, and, also, on the thick oxide film 11 preferably having a thickness of about 200 nm, which is preferably the same as that of the passivation oxide film 8. As a result of thickening the oxide film to about 200 nm in the proximity of the drain, the withstand voltage is improved (FIG. 2H).

Figure 2I:
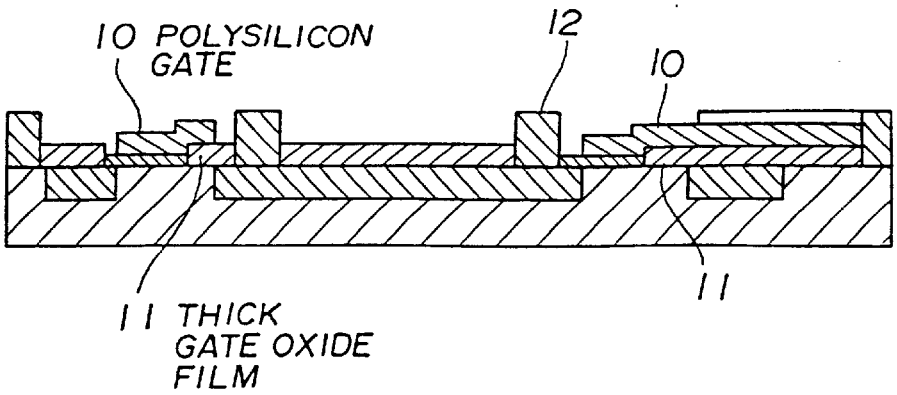

(I) Photoresist of a gate pattern is formed via photolithography, dry etching is performed, and, the polysilicon gates 10 are formed (FIG. 2I).

(K) Patterning of resist is performed via photolithography, RIE is performed using $CHF_3$ gas, and the contact holes 13 are formed (see FIG. 1B).

(L) Then, protection is performed using a photoresist, and dicing is performed.

Figure 3:
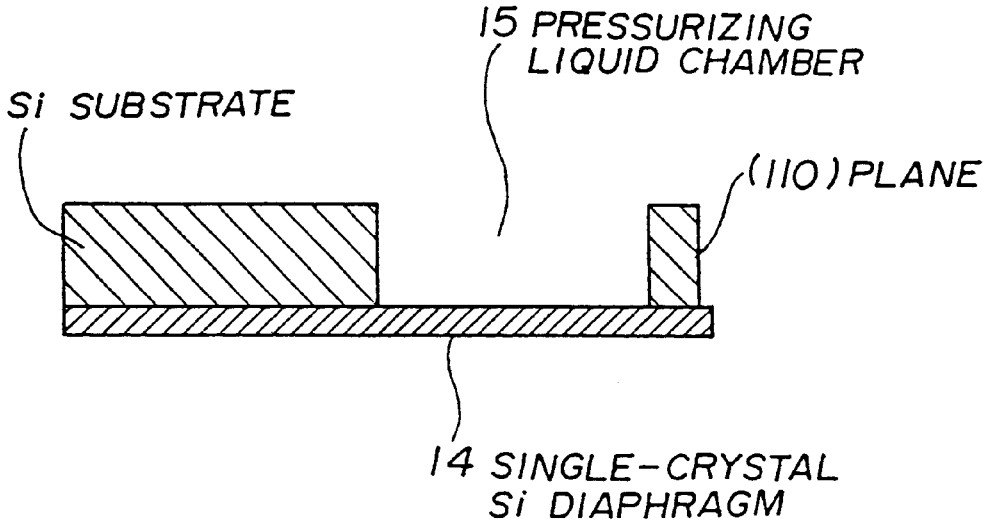
FIG. 3 illustrates a manufacturing process of a diaphragm according to a preferred embodiment of the present invention.

With reference FIG. 3, a process of forming the diaphragm will now be described. A thermal oxide film of about 1.2 μm is preferably formed through thermal oxidation on a Si substrate, and both 110-plane surfaces of the Si substrate preferably were previously polished. The oxide film is removed from the entire surface of only one side, and a high-concentration diffused layer on the order of about $1\times10^{20}/cm^3$ at a depth of about 2 μm is preferably formed on the entire surface as a result of vapor-phase diffusion of B being performed using a solid diffusion source. Patterning of the resist is performed via photolithography on the surface having the oxide film formed thereon, dry etching is performed, and, thus, a pattern of the pressurizing liquid chamber 15 is formed. This pattern is preferably aligned so that the 111 plane is substantially parallel with the long-side direction of the liquid chamber. The surface having B diffused therein is protected using a jig. Anisotropic etching is performed using an aqueous solution of TMAH (TriMethyl Ammonium Hydroxide). At this time, it is possible to leave unetched the single-crystal diaphragm 14 having a thickness of about 2 μm because the etching rate is extremely slow at the high-concentration B layer.

Figure 4:
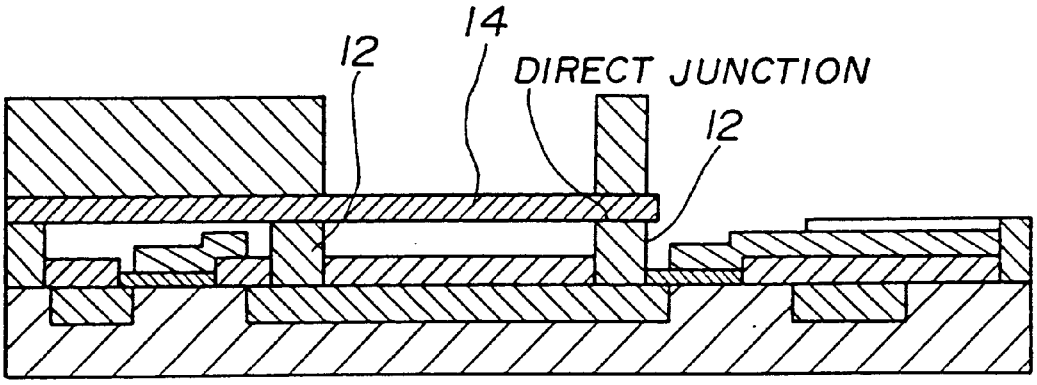
FIG. 4 illustrates a junction between a diaphragm substrate and an electrode substrate according to a preferred embodiment of the present invention.

Then, as shown in FIG. 4, the electrode Si substrate and the diaphragm Si substrate are aligned, and are directly joined in an atmosphere of oxygen at about 1000° C. The portions at which direct junction is performed are the barrier plates 12 which are formed of the oxide films.

Figure 5:
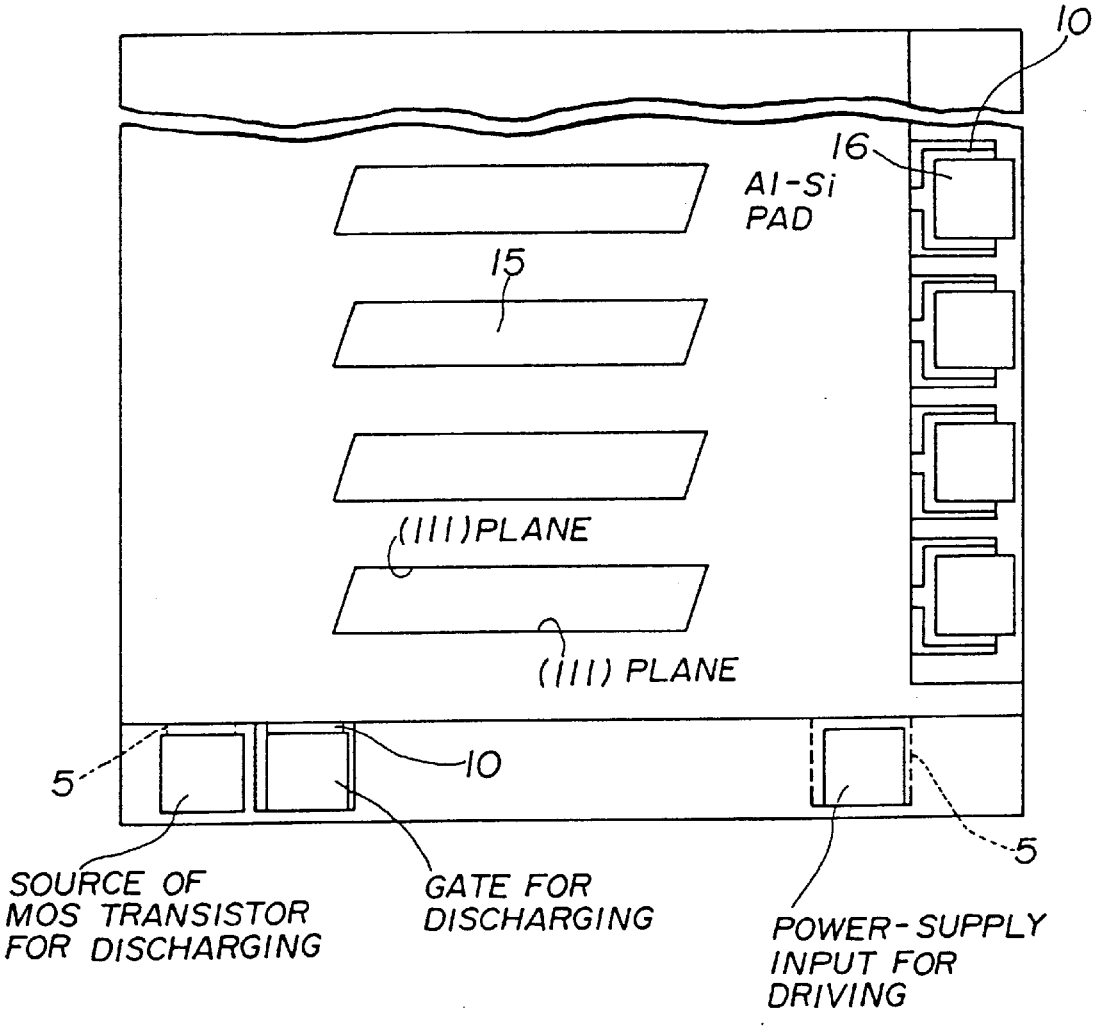
FIG. 5 illustrates an arrangement of pressurizing liquid chambers according to a preferred embodiment of the present invention.

Then, as shown in FIG. 5, a metal mask is used, the oxide films are selectively removed as a result of RIE being performed using $CHF_3$ gas, sputtering of an Al—Si alloy of a thickness of about 300 nm is performed, sintering is performed in an atmosphere of Ar and $H_2$ gas, and, thus, the pads 16 are formed. Thus, the Si substrate and pressurizing liquid chamber portion is manufactured.

Figure 6:
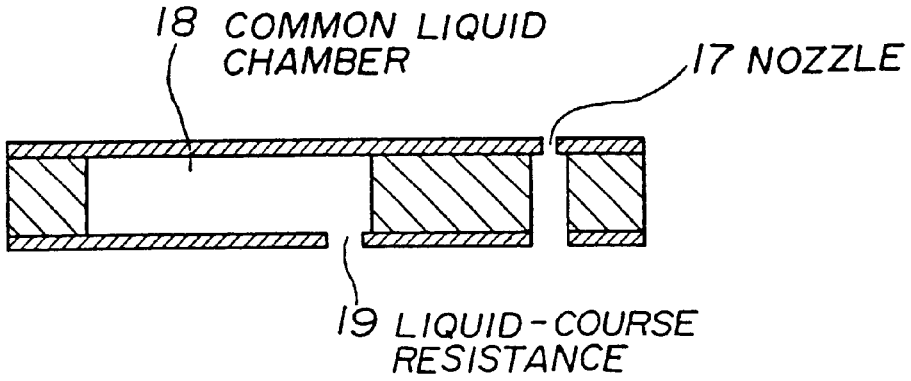
FIG. 6 illustrates a structure of a nozle according to a preferred embodiment of the present invention.
Figure 7:
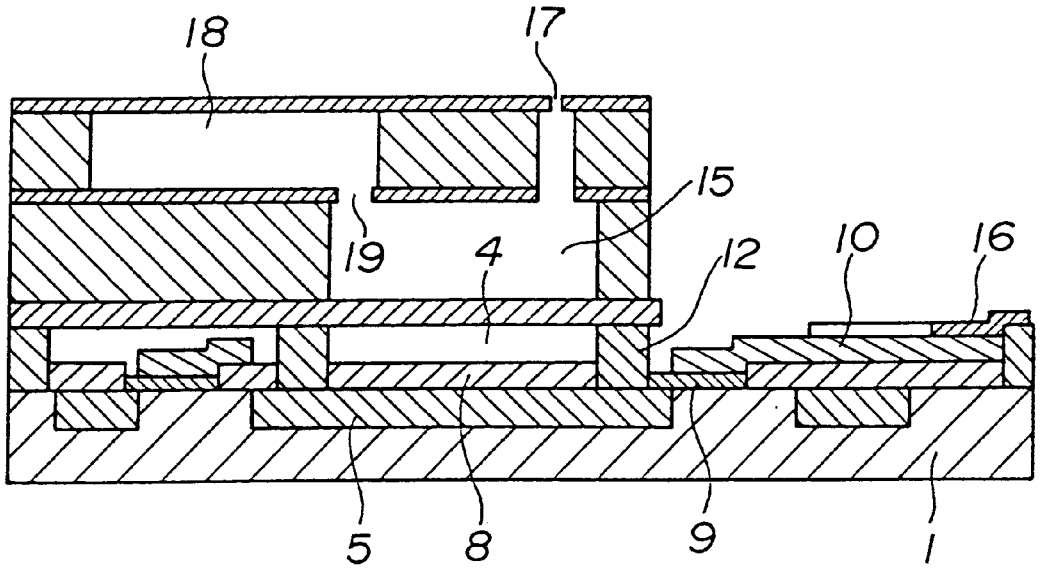
FIG. 7 is a sectional view of the ink-jet head according to a preferred embodiment of the present invention.

Then, as shown in FIG. 6, a stainless-steel plate is processed through etching, and, thus, a hole is formed, and is used as the liquid-course resistance 19. A hole is formed in another stainless-steel plate using a carbon-dioxide laser, and, thus, a hole of the nozzle 17 is formed. The common liquid chamber 18 and a path for the nozzle 17 are formed in another stainless-steel plate through etching. The three stainless-steel plates are stacked and bonded together. Thus, the nozzle 17, the common liquid chamber 18, and the liquid-course resistance 19 are manufactured using the stainless-steel plates. Then, as shown in FIG. 7, the nozzle and common liquid chamber portion is bonded to the Si substrate and pressurizing the liquid chamber portion.

Thus, the ink-jet head having a nozzle density of about 12 nozzles/mm is completed. The short-side length of the diaphragm is preferably about 50 μm, the thickness of the diaphragm is preferably about 2 μm, and the electrical effective gap is preferably about 0.5 μm. When the displacement of the diaphragm necessary for firing ink is about 0.15 μm, the voltage driving the diaphragm directly is about 149 V. However, in the ink-jet head according to preferred embodiments of the present invention, the driving voltage is controlled through the MOS device in the Si substrate, and a voltage is applied to the gate of this MOS device. Thereby, the approximately 0.15 μm displacement of the diaphragm can be performed by a voltage of only about 20 V. Thus, in a staggered arrangement of two 128-nozzle rows in a nozzle density of 300 dpi, printing can be performed with a quality of 200 dpi. At this time, the driving frequency is 60 kHz.

In this structure of the ink-jet head of preferred embodiments of the present invention, when the electric charge stored between the diaphragm and the electrode is discharged, a switch formed of the second MOS transistor for discharging electric charge provided for each nozzle is used. In the first MOS transistor for driving the diaphragm which operates at a high voltage, in order to enable a high-voltage operation, a low-concentration impurity layer is provided on a drain side. As a result, the structure of the MOS transistor is not symmetrical between the source side and the drain side.

Therefore, when a case is considered in which the source and drain are inverted so that the same transistor is also used for discharging electric charge, it is not possible to increase the operation voltage. Therefore, the second MOS transistors only for discharging electric charge are provided separately. In order to confirm the advantage thereof, comparison is performed with the case where the second MOS transistor only for discharging electric charge is not provided. In the structure in which the second MOS transistor only for discharging electric charge is not provided, but the first MOS transistor for driving the diaphragm is also used for discharging electric charge, the ON resistance should be increased, and, in a case where the driving frequency is not less than about 40 kHz, delay in the operation of the diaphragm occurs. Thereby, it is confirmed that, as a result of providing the second MOS transistor only for discharging electric charge for each nozzle, it is possible to prevent decrease in the driving frequency of the diaphragm.

Thus, as a result of providing the MOS transistor for each nozzle, it is possible to prevent increase in the driving voltage which results from reduction in the short-side length of each diaphragm in order to achieve a high nozzle density. Thereby, it is possible to control the MOS transistor so as to control the diaphragm by inputting a signal to the gate using an inexpensive low-voltage driving circuit, and, as a result, to prevent increase in the cost of an electrostatic-type head.

The present invention is not limited to the above-described preferred embodiments, and variations and modifications may be made without departing from the scope of the present invention.

The present invention is based on Japanese priority application No. 10-224120, filed on Aug. 7, 1998, the entire contents of which are hereby incorporated by reference.

What is claimed is:

1. An electrostatic ink-jet head comprising:

At least one nozzle;

at least one liquid chamber including ink in fluid communication with each nozzle;

at least one diaphragm, each diaphragm functionally associated with a nozzle, wherein the diaphragm is deformable so as to allow ink to flow into the at least one liquid chamber when the diaphragm is in a deformed state, and to pressurize the ink in the liquid chamber when the diaphragm returns to a restored state, and is capable of changing from the deformed state to the restored state in which a restoration force is imparted to the liquid chamber to fire ink therefrom; and at least one electrode, each electrode opposite to and functionally associated with a diaphragm, and arranged such that an electrostatic force is produced between the diaphragm and the electrode causing the diaphragm to be deformed, the ink in the chamber being pressurized and fired by the restoration force of the diaphragm, wherein the electrode comprises a diffused layer in a Si substrate and at least one active device is provided in the Si substrate, the active device defining a driving circuit, configured and adapted to store an electric charge on the electrode, thereby producing the electrostatic force used to deform the diaphragm.

2. The ink-jet head according to claim 1, wherein the active device includes at least one MOS transistor.

3. The ink-jet head according to claim 2, wherein the at least one MOS transistor is arranged to control a voltage applied to the electrode to drive the diaphragm.

4. The ink-jet head according to claim 2, wherein the at least one MOS transistor is connected to a power supply line.

5. The ink-jet head according to claim 2, wherein the at least one MOS transistor is arranged to cause an electric charge to escape from the electrode.

6. The ink-jet head according to claim 2, wherein the at least one MOS transistor is connected to ground.

7. The ink-jet head according to claim 1, further comprising at least one first MOS transistor arranged to control a voltage applied to the electrode to drive the diaphragm and at least one second MOS transistor arranged to cause an electric charge to escape from the electrode.

8. The ink-jet head according to claim 7, wherein the first and second MOS transistors are provided for each nozzle.

9. An electrostatic ink-jet head comprising:

at least one nozzle;

at least one liquid chamber including ink in fluid communication with each nozzle;

at least one diaphragm, each diaphragm functionally associated with a nozzle, wherein the diaphragm is deformable so as to allow ink to flow into the at least one liquid chamber when the diaphragm is in a deformed state, and to pressurize the ink in the liquid chamber when the diaphragm returns to a restored state, and is capable of changing from a the deformed state to the restored state in which a restoration force is imparted to the liquid chamber to fire ink therefrom; and at least one electrode, each electrode positioned opposite to and functionally associated with a diaphragm, and arranged such that an electrostatic force is produced between the diaphragm and the electrode causing the diaphragm to be deformed, the ink in the chamber being pressurized and fired by the restoration force of the diaphragm, wherein the electrode comprises a diffused layer in a Si substrate and the diffused layer is part of at least one MOS transistor, configured and adapted to charge the electrode, thereby deforming the corresponding diaphragm.

10. The ink-jet head according to claim 9, wherein the at least one MOS transistor is at least one of a first MOS transistor for controlling a voltage applied to the electrode for driving the diaphragm and a second MOS transistor for causing an electric charge to escape from the electrode.

11. The ink-jet head according to claim 10, further comprising both of the first MOS transistor and the second MOS transistor.

12. The ink-jet head according to claim 10, further comprising both of the first MOS transistor and the second MOS transistor for each nozzle.

13. The ink-jet head according to claim 9, wherein the at least one MOS transistor is arranged to control a voltage applied to the electrode to drive the diaphragm.

14. The ink-jet head according to claim 9, wherein the at least one MOS transistor is connected to a power supply line.

15. The ink-jet head according to claim 9, wherein the at least one MOS transistor is arranged to cause an electric charge to escape from the electrode.

16. The ink-jet head according to claim 9, wherein the at least one MOS transistor is connected to ground.

17. The ink-jet head according to claim 9, further comprising at least one first MOS transistor arranged to control a voltage applied to the electrode to drive the diaphragm and at least one second MOS transistor is arranged to cause an electric charge to escape from the electrode.

18. The ink-jet head according to claim 17, wherein the first and second MOS transistors are provided for each nozzle.

19. A method of making an electrostatic ink-jet head comprising the steps of:

providing a Si substrate;

diffusing a layer in the Si substrate to form an electrode;

providing a diaphragm opposite to and functionally associated with the electrode;

forming an active device in the Si substrate, wherein the active device defines a driving circuit, configured and adapted to charge the electrode, thereby deforming the associated diaphragm, and to discharge the charged electrode, thereby allowing the diaphragm to return to a restored state.

20. The method according to claim 19, wherein the diffused layer is part of at least one MOS transistor.

21. The method according to claim 19, wherein the active device includes at least one MOS transistor.

22. The method according to claim 21, wherein the at least one MOS transistor is arranged to control a voltage applied to an electrode to drive a diaphragm.

23. The method according to claim 21, wherein the at least one MOS transistor is arranged to cause an electric charge to escape from an electrode.

* * * * *